United States Patent [19]

Grigg et al.

[11] Patent Number: 4,600,025

[45] Date of Patent: Jul. 15, 1986

[54] SMOKING PRODUCTS COMPRISING NICOTINE SUBSTITUTES

[76] Inventors: Ronald E. Grigg; Kitti Amornraksa, both of The Queen's University of Belfast, Dept. of Chemistry, David Keir Bldg., Belfast, BT9 5AG, Northern Ireland

[21] Appl. No.: 492,256

[22] Filed: May 6, 1983

Related U.S. Application Data

[63] Continuation-in-part of Ser. No. 442,738, Nov. 18, 1982, abandoned, which is a continuation of Ser. No. 234,803, Feb. 17, 1981, abandoned.

[51] Int. Cl.[4] ..... A24B 15/30; A24B 15/38; A24B 15/40

[52] U.S. Cl. ..... 131/335; 131/360; 131/310

[58] Field of Search ..... 131/335, 278, 270, 352, 131/310, 360; 548/204

[56] References Cited

U.S. PATENT DOCUMENTS

| | | | |
|---|---|---|---|
| 2,702,328 | 11/1972 | Kukolja et al. | 548/204 |
| 3,296,250 | 1/1967 | Fraser et al. | 548/204 |
| 3,536,727 | 10/1970 | Cavella et al. | 548/204 |
| 3,538,107 | 11/1970 | Hepworth et al. | 548/204 |
| 3,700,677 | 10/1972 | Clemence et al. | 548/204 |

FOREIGN PATENT DOCUMENTS

| | | | |
|---|---|---|---|
| 846573 | 8/1960 | United Kingdom | 548/204 |

*Primary Examiner*—V. Millin
*Attorney, Agent, or Firm*—Neal Kalishman

[57] ABSTRACT

A smoking product comprising an inert combustible substrate to which has been applied a nicotine-substitute-effective amount of a compound selected from the group consisting of 2-methyl-5-(pyrrolidinomethyl) thiazole and 2-methyl-5-(piperidinomethyl) thiazole, and the acid addition salts thereof. Thus, for example, a cigarette may include an inert combustible material which is a tobacco substitute onto which one or other effective compound has been impregnated.

1 Claim, No Drawings

SMOKING PRODUCTS COMPRISING NICOTINE SUBSTITUTES

PREVIOUS APPLICATIONS

This is a continuation-in-part of Ser. No. 442,738, filed Nov. 18, 1982 which is a continuation of Ser. No. 234,803, filed Feb. 17, 1981 (now both abandoned).

PRIOR ART

U.S. Pat. Specification No. 4,108,994 (Poittevain et al.) discloses 5-thiazolemethylamine derivatives of the formula

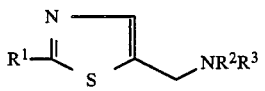

I wherein $R^1$ is $C_{1-6}$ alkyl, and either $R^2$ and $R^3$ are each hydrogen, $C_{1-6}$ alkyl or $C_{1-6}$ hydroxyalkyl, or $NR^2R^3$ forms a heterocyclic ring containing one or two nitrogen atoms and bearing, if desired, a $C_{1-4}$ alkyl substituent, and acid addition salts thereof. Various examples of suitable heterocyclic rings are described. Syntheses of these compounds are described, starting from 2-alkyl-5-thiazolemethyl halides.

The compounds exemplified by Poittevain et al. are those of formula I in which $R^2$ and $R^3$ are each H, $CH_3$ or $HOCH_2CH_2$, and also 2-methyl-5-(piperidinomethyl)thiazole hemiethanedisulphonate and 2-methyl-5-(4-methylpiperazinomethyl)thiazole. The compounds are associated with anti-lipolytic activity, in that they reduce the amount of plasma free fatty acids, and hypoglycaemic activity. Pharmaceutical compositions are described, but the only specific examples of compositions, and the only test results (given in the corresponding French Publications Nos. 2,323,383 and 2,372,678) relate to compounds in which $R^2$ and $R^3$ are each hydrogen, alkyl or hydroxyalkyl, except for a $LD_{50}$ test on the 4-methylpiperazino derivative.

U.S. Pat. Specification No. 3,966,950 describes 2-alkyl-5-thiazolecarboxamides having α-adrenolytic activity. French Patent Publication No. 2,209,557 discloses, as intermediates, 2-propyl-5-thiazolecarboxamides.

DESCRIPTION OF THE INVENTION

It has now been discovered that 2-methyl-5-(piperidinomethyl)thiazole and the novel compound 2-methyl-5-(pyrrolidinomethyl)thiazole and their acid addition salts, are of utility in stimulation of the central nervous system. These compounds can be prepared by reduction of the novel compounds 2-methyl-5-(piperidinocarbonyl)-thiazole and 2-methyl-5-(pyrrolidinocarbonyl)thiazole, respectively.

The active compounds are within the scope of formula I. They are equivalent to that formula when $R^1$ is methyl and $NR^2R^3$ is piperidino or pyrrolidino, respectively.

For the reduction, the preferred reducing agent is lithium aluminium hydride. The reduction is usually conducted in a solvent such as ether.

The novel carboxamides may be prepared by reacting a 2-methyl-5-thiazolecarbonyl halide or 2-methyl-5-thiazolecarboxylate ester with piperidine or pyrrolidine at from ambient temperature to 100° C. The use of an alkyl, and most preferably the ethyl, ester is preferred.

The reaction is preferably conducted in the presence of excess amine, as solvent, although substantially equimolar amounts of the halide/ester and amine may be used for reaction.

Suitable halides and esters for use as starting materials are known. Those which are not known may be made by procedures which are generally known, or analogous to those which have been described. A suitable halide may be prepared from the corresponding acid by reaction with thionyl chloride in the presence of pyridine. A suitable esters may be prepared by reacting thioacetamide with an alkyl, e.g. ethyl, α-chloro-α-formylacetate.

By way of alternative, the active compounds of the invention may be prepared by reduction of 2-methyl-5-thiazolecarboxaldehyde with piperidine or pyrrolidine, in the presence of sodium cyanoborohydride. Suitable reaction conditions are in buffered solution at a pH of from 4 to 5, at from ambient temperature to 50° C.

In addition to their stimulatory effect on the cns, the active compounds of the invention have low peripheral activity. They can give a pleasurable sensation to the user, and may be self-administered for this purpose.

The compounds may be formulated as compositions for oral, parenteral or rectal administration. They may be formulated in conventional pharmaceutical manner, with a physiologically acceptable excipient or inert carrier which is administered to the subject with the active ingredient, or they may be formulated such that much of the composition remains outside the body, only the active ingredient and some other materials being taken into the body. For example, if the active ingredient is to be administered by inhalation, the composition may be in the form of a smoking product comprising a conventional inert combustible substrate to which an appropriate amount of one or each active compound of the invention has been applied.

The compounds of the invention may be represented in a variety of tautomeric forms. These forms are within the scope of the invention.

The following Examples illustrate how compounds of the invention may be prepared.

EXAMPLE 1

2-Methyl-5-(pyrrolidinocarbonyl)thiazole

A mixture of 15.42 g (0.0901 mole) of ethyl 2-methyl-5-thiazolecarboxylate and 12 g pyrrolidine was stirred at 120° C. under a nitrogen atmosphere for 36 hours to give 12.91 g of the title compound, m.p. 71–2°C. (78.6% yield with respect to the ester).

Example 2

2-Methyl-5-(piperidinocarbonyl)thiazole

In a manner parallel to that of Example 1, the title compound was prepared as white crystals, m.p. 68.7° C.

EXAMPLE 3

2-Methyl-5-(pyrrolidinomethyl)thiazole

A solution of 2-methyl-5-(pyrrolidinocarbonyl)-thiazole in dry ether was added dropwise to a suspension of lithium aluminium hydride and the mixture was stirred at room temperature to give the title compound as a colourless liquid, b.p. 61–62°C.

EXAMPLE 4

2-Methyl-5-(piperidinomethyl)thiazole

Following the procedure of Example 3, the product of Example 2 was reduced to give the title compound as a colourless liquid, b.p. 65–66°C.

The products of the Examples are soluble in water and ethanol.

The products of the Examples have been tested for their biological activity. Peripheral activity was determined by contraction of the guinea pig ileum while central nervous system activity was determined by Irwin profile observations. Frog rectus contraction was also observed. The following Table gives results for compounds of formula I

| $R^1$ | $NR^2R^3$ | ileum | rectus | Irwin |
|---|---|---|---|---|
| Me | piperidino | 0.07 | 1.0 | 1.0 |
| Me | pyrrolidino | 0.15 | 2.5 | 1.25 |
| Me | $N(Et)_2$ | 0.0014 | 0.02 | 0.06 |
| Ph | piperidino | $<10^{-5}$ | $<10^{-5}$ | inactive |
| Ph | pyrrolidino | 0.5 | | 0.05 |
| Et | pyrrolidino | | | 0.05 |
| t-Bu | pyrrolidino | | | 0.03 |
| Me | 2,5-dimethylpyrrolidino | | | 0.07 |
| Me | morpholino | $<10^{-5}$ | $<10^{-5}$ | inactive |
| s-Pr | pyrrolidino | | | inactive |

The 4-methyl analogues of, and the 5-thiazolecarboxamides corresponding to, the first four 5-thiazolemethylamines given in the Table, and also 4-methyl-5-(pyrrolidinomethyl) thiazole, are essentially inactive in the same tests and certainly no more than 0.02 in the Irwin profile. The $LD_{50}$ values for each of the first two compounds in the Table (i.e. the compounds of Examples 3 and 4) are 7–8 mg/kg.

These results show the unpredictability of the central/peripheral activity ratio. The surprisingly good ratio for the active compounds of the invention (of the order of 10 times that of nicotine) shows that the compounds are potentially of value as substitutes for nicotine, giving similar cns stimulation but with advantageously reduced peripheral activity. A high ratio, but low overall activity, is observed for 2-methyl-5-(diethylaminomethyl)thiazole.

A smoking product of the invention may be in the form of, for example, a cigarette or tobacco substitute which carries, e.g. by impregnation onto an inert combustible material by conventional means, an active compound of the invention. The material may also include or carry substances which, for examples, aid or retard burning, and/or flavour additives. These and other variations will be readily apparent to those skilled in the art, and are within the scope of the invention as defined by the following claim:

We claim:

1. A smoking product comprising an inert combustible substrate to which has been applied a nicotine-substitute-effective amount of a compound selected from the group consisting of 2-methyl-5-(pyrrolidinomethyl)-thiazole and 2-methyl-5-(piperidinomethyl)thiazole, and the acid addition salts thereof.

* * * * *